US008770978B2

(12) United States Patent
Botten

(10) Patent No.: US 8,770,978 B2
(45) Date of Patent: Jul. 8, 2014

(54) ELECTRONIC BLANK AMMUNITION

(75) Inventor: Steffen Botten, Skien (NO)

(73) Assignee: Nimtec AS, Skein (NO)

( * ) Notice: Subject to any disclaimer, the term of this patent is extended or adjusted under 35 U.S.C. 154(b) by 234 days.

(21) Appl. No.: 13/394,338

(22) PCT Filed: Oct. 8, 2010

(86) PCT No.: PCT/NO2010/000357
§ 371 (c)(1),
(2), (4) Date: Apr. 30, 2012

(87) PCT Pub. No.: WO2011/043673
PCT Pub. Date: Apr. 14, 2011

(65) Prior Publication Data

US 2012/0329364 A1 Dec. 27, 2012

Related U.S. Application Data

(60) Provisional application No. 61/249,750, filed on Oct. 8, 2009.

(30) Foreign Application Priority Data

Oct. 8, 2009 (NO) ..... 2009 3112

(51) Int. Cl.
*F41A 33/00* (2006.01)
*F41A 33/04* (2006.01)

(52) U.S. Cl.
CPC ..... *F41A 33/04* (2013.01)
USPC ..... 434/16

(58) Field of Classification Search
CPC ..... F41A 33/00; F41A 33/04
USPC ..... 434/11, 16, 24
See application file for complete search history.

(56) References Cited

U.S. PATENT DOCUMENTS

| | | | | |
|---|---|---|---|---|
| 2,836,919 | A * | 6/1958 | Du Bois | 42/57 |
| 4,380,437 | A * | 4/1983 | Yarborough, Jr. | 434/18 |
| 4,416,631 | A | 11/1983 | Dawson et al. | |
| 4,521,195 | A | 6/1985 | Moberg | |
| 4,654,008 | A * | 3/1987 | Elmore | 434/16 |
| 8,528,244 | B2 * | 9/2013 | Scallie et al. | 42/84 |
| 8,602,784 | B2 * | 12/2013 | Dvorak | 434/18 |
| 8,646,201 | B2 * | 2/2014 | Hughes et al. | 42/114 |
| 2005/0191601 | A1 * | 9/2005 | Dvorak | 434/16 |
| 2008/0127538 | A1 * | 6/2008 | Barrett et al. | 42/1.02 |
| 2010/0003643 | A1 * | 1/2010 | Seo | 434/21 |

OTHER PUBLICATIONS

Norwegian Search Report for 20093112 dated May 1, 2010.

* cited by examiner

*Primary Examiner* — Kurt Fernstrom
(74) *Attorney, Agent, or Firm* — Marshall, Gerstein & Borun LLP

(57) ABSTRACT

A system for electronic simulation of live ammunition when firing a small arms, comprising:

a magazine to be inserted in a magazine funnel of the arms simulating a live ammunition magazine;

a trigger module to be mounted on the arms, the trigger module comprising a trigger actuator for mounting on a trigger of the arms and a safety catch actuator for mounting on a safety catch on the arms; and a sound producing device for simulation of shots.

The invention replaces ordinary blank ammunition in the magazine with an electronic solution.

15 Claims, 11 Drawing Sheets

Trigger module
For mounting inside the arms

ELECTRONIC BLANK AMMUNITION

The present invention relates to a system for electronic simulation of live ammunition detonated from a firing device, in particular a small arms.

BACKGROUND

Blank ammunition is applied in considerable amounts globally. Blank ammunition is a disposable consumer product which remains in nature after application. As it is made of plastic and metal, the decomposition process will be long-lasting and therefore damage the environment. In addition, considerable amounts of environmentally damaging waste will be created by the use of powder charge.

Blank ammunition has limitations in terms of where it can be applied, as fouling will create marks and pollute the environment. An example is during indoors training in buildings, onboard planes or other civil installations in which exercise is required.

There is a security risk related to the application of blank ammunition as particles from the firing device, and/or heat, can cause damage on people or objects that are in proximity of the firing device. Application of blank ammunition can also cause hearing impairment as the noise level is very high.

Blank ammunition causes the firing device to wear and tear. Sediments in the barrel cause additional need for cleaning of the firing device. Furthermore, blank ammunition has a tendency of getting jammed in the breech, which can spoil drills and other training. There is also a high procurement cost on blank ammunition.

U.S. Pat. No. 4,416,631 describes a small arms firing effects simulator using a pyrotechnical solution. U.S. Pat. No. 4,521,195 concerns a device for simulating the report effect of a blank cartridge when firing small arms by using a pressurized gas container. The device may be implemented as a magazine which can be fitted to a weapon instead of its ordinary magazine. Both these prior art systems do however not provide a full simulation of the weapon as the weapon may not be used in the normal way during simulation.

BRIEF DESCRIPTION OF THE PRESENT INVENTION

The invention presents a solution to the challenges as described above.

In a first aspect the invention provides a system for electronic simulation of live ammunition when firing a small arms, comprising: a magazine to be inserted in a magazine funnel of the arms simulating a live ammunition magazine; a trigger module to be mounted on the arms, the trigger module comprising a trigger actuator for mounting on a trigger of the arms and a safety catch actuator for mounting on a safety catch on the arms; and an electronic sound generating device for simulation of shots.

The system may further comprise an electronic lighting device for simulation of muzzle flame when firing the arms. This electronic lighting device may be a LED.

The trigger module is a separate module from the magazine. In an embodiment, the trigger module may further comprise at least one sensor for sensing a position of the safety catch of the arms. The trigger module may also include at least one sensor for sensing a position of the trigger of the arms. These sensors may be switches.

In an embodiment, the trigger module may be mounted in connection with a magazine funnel on the arms. In an alternative embodiment, the trigger module may be mounted inside the arms connected to an inner part of the trigger and an inner part of the safety catch.

The magazine may comprise contacts for connection with reciprocal contacts on the trigger module for transfer of signals between the magazine and the trigger module. The magazine may comprise a bolt micro-switch arranged to be activated by a loading motion of the arms. Further, the magazine may comprise at least one battery for powering the system, an electronic controller controlling the simulation, an electronic display indicating a number of shots/rounds fired and a number of shots/rounds remaining. A reset button resetting the system may be implemented into the magazine module. The battery may be rechargeable.

The trigger module could be installed in connection with the trigger mechanism of the firing device. The trigger module could further also include a trigger button to be installed on the trigger of the device. The trigger module could also include a safety switch to be installed on the safety catch of the device. The trigger button could be installed on a trigger button fastener adapted to the specific construction of the device.

The invention can replace blank ammunition which is applied for military and civil training where live firing is not applicable. The aim is to replace the sound of a shot or an explosion with an electronic sound generator, instead of gunpowder.

The invention will be replace or supplement today's blank ammunition, where gun powder is applied to create the sound of a shot or an explosion.

The invention will be produced by components that do not contain environmentally damaging substances. As the sound is produced electronically, it will not create any kind of waste gas. It can also be reset and recharged, and hence applied multiple times. At the end of its operating time, the invention can be recycled like any electronic consumer product.

The electronic blank ammunition contains no waste products which can leave marks or pollute the environment. This will make training in installations for which there were formerly no solutions, more realistic.

The invention has no waste products which will be exposed in high speed or produce heat. Therefore it endangers neither people nor objects.

The invention can have an adjustable volume level, so that the risk of hearing impairment is reduced.

As the invention will not leave marks in the firing device or get jammed in the breech, it will be more reliable for application.

The electronic blank ammunition can be applied multiple times, which makes the product a more cost-effective solution.

The invention provides a full electronic simulation system enabling the use of the weapon in a normal way also during simulation. This means that the loading, triggering and safety systems of the weapon may be used in the same way as when firing live ammunition. The trigger module is implemented as an own module separate from the magazine. The trigger module is connected directly to the trigger and bolt of the weapon, enabling use of the trigger and bolt of the weapon in the normal way as described above.

The system includes battery-driven micro-controlled electronics. This is activated via micro-switches attached to the safety catch of the firing device, providing single or multiple shots. Simulation of shots occurs as the trigger of the firing device activates a micro-switch installed on the device, which in its place activates a micro-controller. This plays a sound file which is sent to an amplifier (e.g. of class D) and forwarded to an electronic sound generator (e.g. a loudspeaker). Simultaneously, the micro controller activates an electronic light diode (e.g. LED) to simulate a muzzle flame by a strong gleam of light. The micro controller registers the number of shots fired and the remaining shots. This can be read from an LED display, which is installed into a unit of a size corresponding to the live ammunition magazine and the appurtenant trigger module.

BRIEF DESCRIPTION OF THE DRAWINGS

In the following, example embodiments of the invention will be explained with reference to the following drawings.

DETAILED DESCRIPTION OF THE PRESENT INVENTION

Example Embodiment 1

FIG. 1.

Magazine (1): Batteries, microcontroller, electronic sound generator and lighting device built in.

Trigger module (2): This is a liner that is installed on the firing device, which is custom-made for each type of device. It is installed on the firing device and has a connection with the magazine. Upon this is the trigger button (3) which is installed on the trigger mechanism of the firing device, and also safety buttons (4) which are installed on the safety mechanism of the device.

FIG. 2

On the magazine (FIG. 1,1) there is a hole (5) for the magazine bracket. This is put so that the fastening point and the release of the device correspond to a regular magazine.

Figure 1:
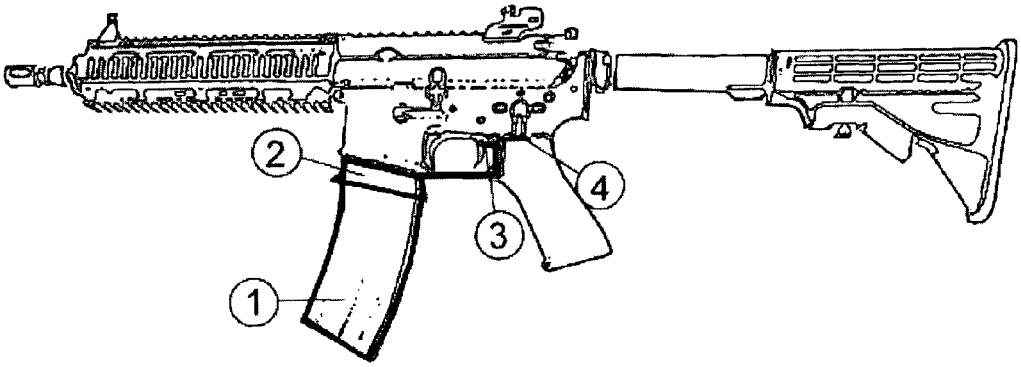
FIG. 1 shows a firing device with an installation for electronic blank ammunition constructed in accordance with a first embodiment of the present invention.
Figure 2:
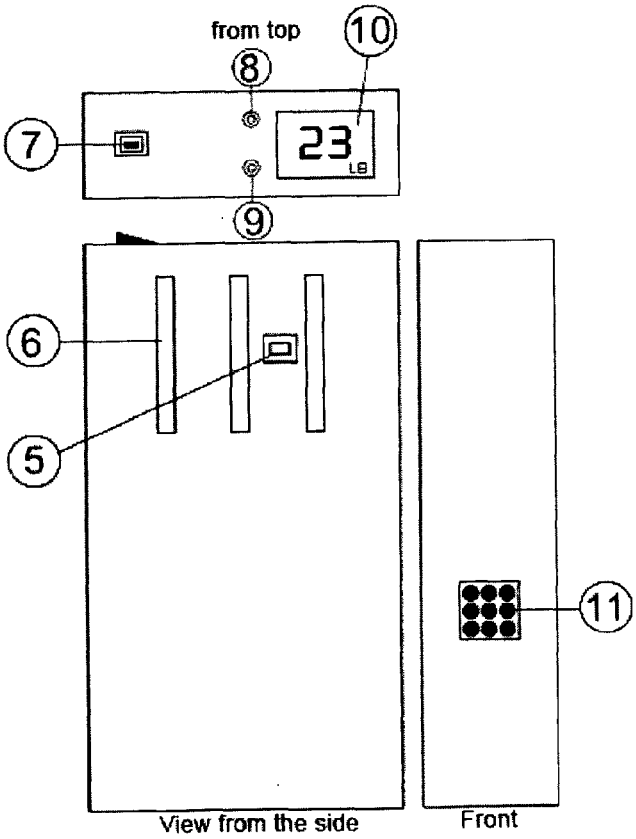
FIG. 2 shows a sketch of the magazine seen from above, seen from the front and seen from the side of the installation for electronic blank ammunition as shown in FIG. 1.

On the top there are installed contacts (6) for transfer of signals from the trigger module (FIG. 1,2). On the top there is installed a box staple button (7) that will be activated by loading motion. The LED display (10) on the top is an electronic counter that displays the number of remaining shots. This is activated by pressing the display button (8). When there are no remaining shots, the counter is reset by pressing the reset button (9).

In the front there is installed a LED light (11) for simulation of muzzle flame.

FIG. 4

In the lower part of the magazine (FIG. 1,1) a electronic sound generator (12) is installed for simulation of shots. Above this is the battery pack (13) as an electricity source for the electronic trunk circuit card (15), ref. electronic block diagram, and to the secondary electronic circuit card (14), ref. electronic block diagram.

FIG. 3

On the trigger module (FIG. 1,2) there is a contact unit (16) in the magazine funnel of the firing device. The trigger module is implemented as a separate module from the magazine. The trigger module may further include at least one sensor for sensing a position of the safety catch of the arms. The trigger module may also be provided with at least one sensor for sensing a position of the trigger of the arms.

The magazine (FIG. 1,1) is inserted here like a regular magazine. On the interior of the contact unit (16) are sliding contacts (17,18) for transfer of signals (electrical, optical etc) between the magazine (FIG. 1,1) the trigger button (23) (FIG. 1,3), and safety buttons (21,22) (FIG. 1,4). The trigger button (actuator) (23) is installed on the trigger button mechanism (20) which is adapted to the specific trigger construction of the firing device. This is for the firing to correspond with live ammunition firing.

There are two buttons (actuators) installed on the safety mechanism of the firing device. When the safety catch of the device is set in function, the single-shot button (22) is "semi"-activated, and prepares the electronics for firing a single-shot. The safety catch can also be set in "auto"-function, where the multiple-shot button (21) is activated, and the electronics prepared for firing multiple shots. These actuators are connected to the trigger and the safety mechanism of the weapon. The trigger actuator is mounted on a trigger of the arms and the safety catch actuator is mounted on a safety catch on the arms.

The trigger module (FIG. 1,2) is installed rapidly on inside of the firing device by a cleat system which locks the module to the trigger and the safety mechanism of the device (19).

Example Embodiment 2

FIG. 5

Magazine (25): Only electronic sound generator built in.

Trigger module (26): This is a liner that is installed on the firing device, which is custom-made for each type of device. It is installed inside the magazine and has a connection with the magazine and electronics/battery module. Upon this is the trigger button (27) which is installed on the trigger mechanism of the firing device, and also safety buttons (28) which are installed on the safety mechanism of the device.

Electronics and battery module (24): This is a module for batteries, electronics unit and electronic sound generator.

FIG. 6

In the electronics and battery module (FIG. 5,2), the battery pack (30) is installed as a power source for the electronic circuit card (29), ref. electronic block diagram. In the front are the LED lights (31) installed for simulation of muzzle flame.

On the side a LED display (32) is installed. This is an electronic counter which displays number of remaining shots. It is activated by pushing the display button (33). When there are no remaining shots, the counter is reset by pressing the reset button (34).

The electronics and battery module (FIG. 5,24) is attached to the firing device by a standard weapon bracket (35), and interconnected with the trigger module (FIG. 5,26) by a connection bridge (36).

FIG. 7

On the trigger module (FIG. 5,26) there is installed a contact unit (37) in the magazine funnel of the firing device.

The magazine (FIG. 5,26) is inserted here like a regular magazine.

Figure 5:
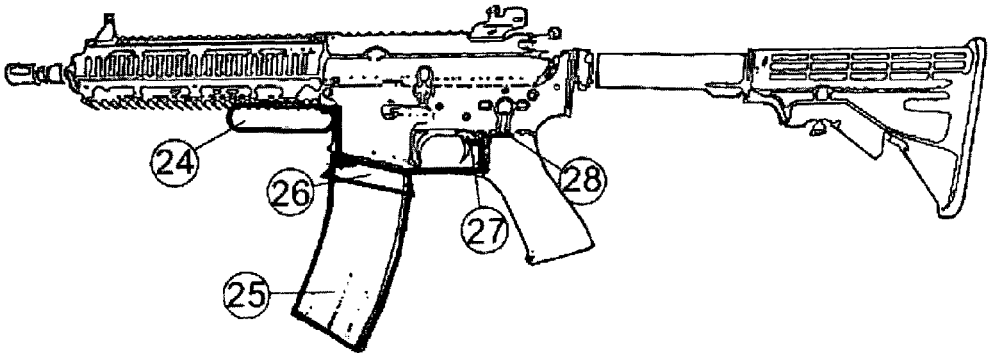
FIG. 5 shows a firing device with an installation for electronic blank ammunition with separate light, battery and electronics modules in accordance with a second embodiment of the present invention.

On the interior of the contact unit (37) are contacts (38, 39) for transfer of signals between the magazine (FIG. 5,25) the trigger button (44) (FIG. 5,27), and safety buttons (42, 43) (FIG. 5,28). The electronics and battery module is connected to the connection point (45). The trigger button (44) is installed on the trigger mechanism (41) which is adapted to the specific trigger construction of the firing device. This is for the firing to correspond with live ammunition firing.

There are two buttons installed on the safety mechanism of the firing device. When the safety catch of the device is set in function, the single-shot button (43) is "semi"-activated, and prepares the electronics for firing a single-shot. The safety catch can also be set in "auto"-function, where the multiple-shot button (42) is activated, and the electronics prepared for firing multiple shots.

The trigger module (FIG. 5,26) is installed rapidly on the inside of the firing device by a cleat system which locks the module to the trigger and safety mechanism of the device (40).

FIG. 8

On the magazine (FIG. 5,25) there is a hole (46) for the magazine bracket. This is put so that the fastening point and the release of the device correspond to a regular magazine.

On the top contacts are installed (47) for transfer of signals from the trigger module (FIG. 5,26). On the top there is installed a box staple button (48) that will be activated by loading motion.

FIG. 9

In the magazine there is installed an electronic sound generator (49) for simulation of shots.

Example Embodiment 3

FIG. 10

Magazine (50): Batteries, electronics unit and lighter built in.

Trigger module (51): This is a liner that is installed on the firing device, which is custom-made for each type of device. It is installed in the magazine funnel of the device and has a spring-loaded connection with the magazine and the electronic sound generator module (52). Upon this is the trigger button (53) which is installed on the trigger of the firing device, and also safety buttons (54) which are installed on the safety catch of the device.

Speaker module (52): This is a module for electronic sound generator installed in front on the firing device and outside of the magazine (50).

FIG. 11

In the electronic sound generator module (FIG. 10,52) there is installed a electronic sound generator (55) for simulation of shots.

The electronic sound generator module (FIG. 10,52) is attached to the firing device by a standard weapon bracket (56) and interconnected with the trigger module (FIG. 10,51) by a connection bridge (57).

FIG. 12

On the trigger module (FIG. 10,51) there is installed a contact unit (58) in the magazine funnel of the firing device.

The magazine (FIG. 10,50) is inserted here like a regular magazine.

Figure 10:
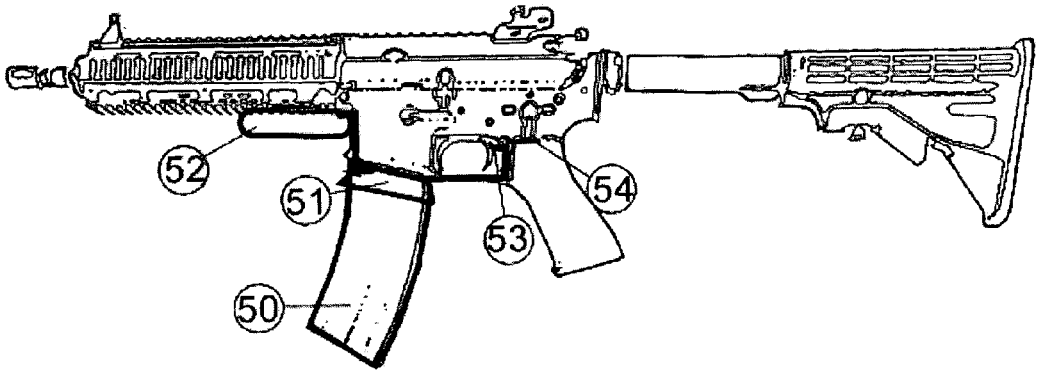
FIG. 10 shows a firing device with an installation for electronic blank ammunition with a separate electronic sound generator module installed on the front of the device in accordance with a third embodiment of the present invention.

On the interior of the contact unit (58) are contacts (59, 60) for transfer of signals between the magazine (FIG. 10,50) the trigger button (66) (FIG. 10,53), and safety buttons (64, 65) (FIG. 10, 54). The electronic sound generator module (FIG. 10,52) is connected to the connection point (61). The trigger button (66) is installed on the trigger mechanism (63) which is adapted to the specific trigger construction of the firing device. This is for the firing to correspond with live ammunition firing.

There are two buttons installed on the safety catch of the firing device. When the safety catch of the device is set in function, the single-shot button (65) is "semi"-activated, and prepares the electronics for firing a single-shot. The safety catch can also be set in "auto"-function, where the multiple-shot button (64) is activated, and the electronics prepared for firing multiple shots.

The trigger module (FIG. 10,51) is installed rapidly on the inside of the firing device by a cleat system which locks the module to the device (62).

FIG. 13

On the magazine (FIG. 10,50) there is a hole (67) for the magazine bracket. This is put so that the fastening point and the release of the device correspond to a regular magazine.

On the top there are installed contacts (68) for transfer of signals from the trigger module (FIG. 10,51). On the top there is installed a box staple button (69) that will be activated by loading motion.

The LED display (72) on the top is an electronic counter that displays number of remaining shots. This is activated by pressing the display button (70). When there are no remaining shots, the counter is reset by pressing the reset button (71).

In the front there is installed a LED light (73) for simulation of muzzle flame.

FIG. 14

In the lower part of the magazine (FIG. 10,50) the electronic trunk circuit card (74), ref. electronic block diagram, is installed. Above this is the battery pack (75) as an electricity source for the electronic trunk circuit card (74), (ref. electronic block diagram), and to the secondary electronic circuit card (14), (ref. electronic block diagram), which is installed in the top.

The installation for electronic simulation of (live) ammunition at the firing of a firing device is activated by inserting the magazine (1,25,50), making a loading motion and switch off the safety catch. This by the activation of a box staple button (7,48,69) as the box staple is pulled back and a safety button on the safety catch of the firing device is activated. The product is now in stand-by modus.

On the trigger of the firing device there is installed a trigger button (20,44,66). When the trigger is pulled, an entry signal is given to the electronics unit (15,29,74), which sets off a sound file equaling the sound of a shot. This is forwarded to an amplifier (89) which sends the sound to an electronic sound generator (12,49,55,88).

Simultaneously, the electronics unit (15,29,74) sends a signal to a lighter (11,31,73,86) for simulation of a muzzle flame, and sets off a counter in order to see how many "shots" are remaining in the magazine (1,25,50). This is displayed in an LED display (10,32,73,87), which has its own activation button (8,33,70) for display of remaining "shots". When the magazine (1,25,50) is empty, it can be reset a certain number of times before the battery (13,30,75) needs to be recharged.

The product's mode of operation:

The product is battery-driven. The selected batteries are particularly fit for the purpose (high deduction of power).

The electronics unit contains main parts like a DC/DC converter, micro controller and amplifier. The product also contains a custom-designed electronic sound generator and a lighter.

Application:

Before training, the trigger module must be installed on the firing device and a fully loaded magazine inserted in the trigger module.

To activate the product, the box staple on the firing device must be pulled back equivalent to the first loading motion with regular ammunition.

The product is now ready to be activated as the safety catch is switched off. The micro button on the safety catch of the firing device sets the electronics in the magazine in stand-by modus, ready for firing. This happens by pressing the trigger of the firing device the same way as when firing a regular shot.

This can be done multiple times before the magazine must be reset or recharged. The number of times will vary according to type of firing device or magazine.

Figure 15:
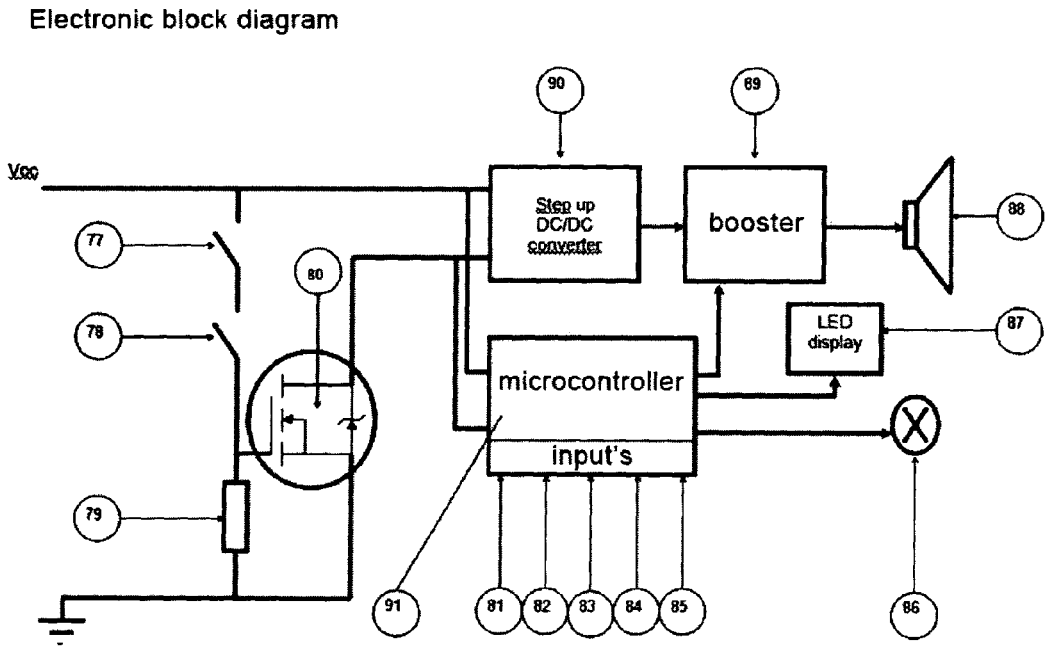
FIG. 15 shows a sketch of an electronic module according to an embodiment of the invention for controlling the installation for electronic blank ammunition.

The invention provides a unit of a size corresponding to a live ammunition magazine (1,25, 50) containing: Powerful, rechargeable battery pack, electronic circuit (FIG. 15), electronic sound generator (e.g. loudspeaker), electronic LED light, LED display, reset button, contact points, buttons for light and sound volume with the following mode of operation:

First, the button for loading motion is activated as loading motion is made (77). Then the safety catch is unfastened and the safety catch button (78) is put in. The loading motion button (77) and the safety catch button (78) are connected in series, and when these are put in, the hexfet button (80) will lead and start step up converter (90) and micro controller (91) in resting mode, ready to fire. When the loading motion button (77) and the safety catch button (78) are out, resistance for the hexfet button (79) functions as a latch, and the hexfet button (80) will not lead. The microcontroller (91) has five entries: Button entry for volume control (83) which defines desired sound volume; button entry for single or multiple shots (82); trigger entry (84) which is from the trigger of the firing device; manual reset (81) and automatic reset by loading (85). By pulling the trigger (trigger entry) (84), the micro controller will play a stored sound file corresponding to the sound of a shot from regular ammunition, which is sent to the amplifier (89) which again sounds from an electronic sound generator (88). Simultaneously, a strong LED light (86) will be set off to simulate the muzzle flame. The micro controller (91) counts the number of shots fired and after 30 shots the circuit needs to be reset manually (81). The LED display (87) will show number of remaining shots. After a predefined number of resets, the micro controller (91) will lock the circuit and BL will appear in the LED display (87) because the batteries need to be recharged. When the batteries are recharged, the entry for automatic reset by loading (85) will be activated and the circuit can be restarted.

FIG. 15

Electronics module for electronic blank ammunition.

LIST OF REFERENCE NUMERALS OF FIGURES

77 Button for loading motion
78 Button for safety catch of the firing device
79 Resistance for Hexfet button
80 Hexfet button functions as main button
81 Manual reset entry
82 Entry for single-shot/multiple shots button (semi/auto)
83 Volume control, full/half volume
84 Trigger
85 Automatic reset by loading
86 LED light for simulation of muzzle flame
87 LED display for display of remaining shots in magazine
88 Electronic sound generator
89 Amplifier
90 Step up converter
91 Micro controller

FIG. 16

Figure 3:
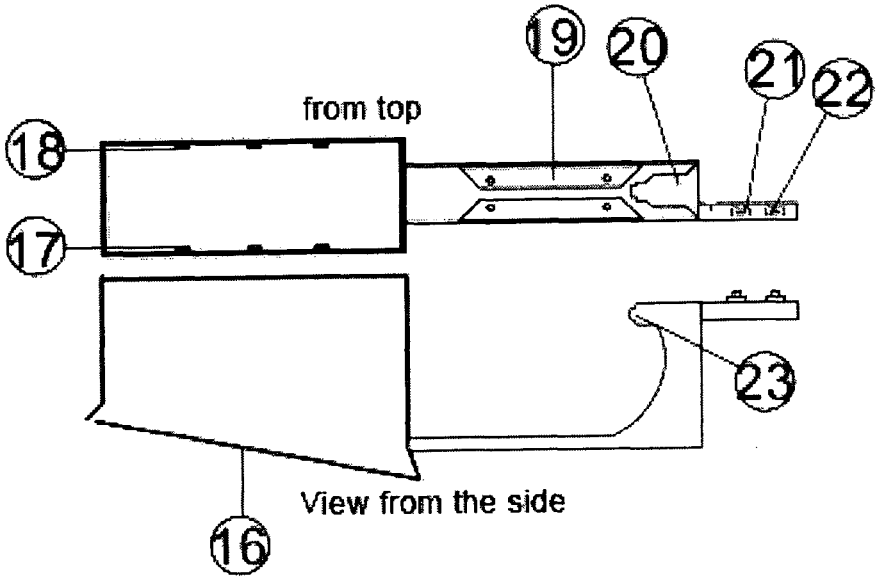
FIG. 3 shows a sketch of a trigger module seen from the side and from above for electronic blank ammunition in accordance with the embodiment shown in FIG. 1.
Figure 4:
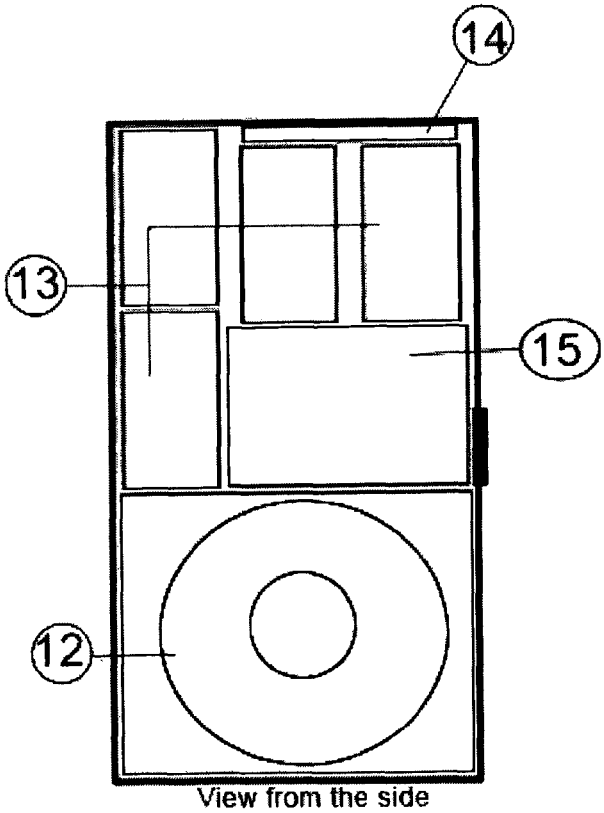
FIG. 4 is a sketch of the interior of the magazine with an electronic sound generator in the lower part in accordance with the embodiment shown in FIG. 1.
Figure 7:
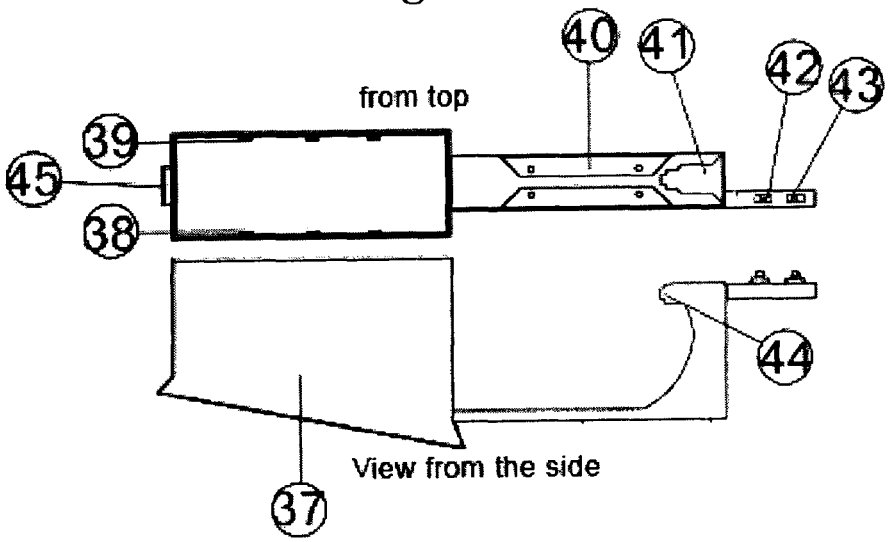
FIG. 7 shows a sketch of a trigger module seen from the side and from above for electronic blank ammunition in accordance with the second embodiment as shown in FIG. 5.
Figure 8:
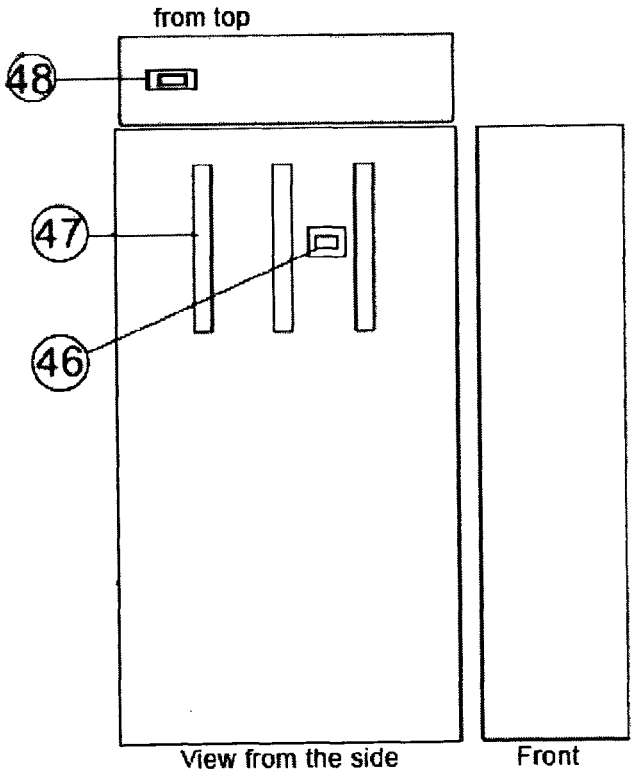
FIG. 8 shows a sketch of the magazine seen from above, from the front and from the side in the installation for electronic blank ammunition in accordance with the second embodiment as shown in FIG. 5.
Figure 9:
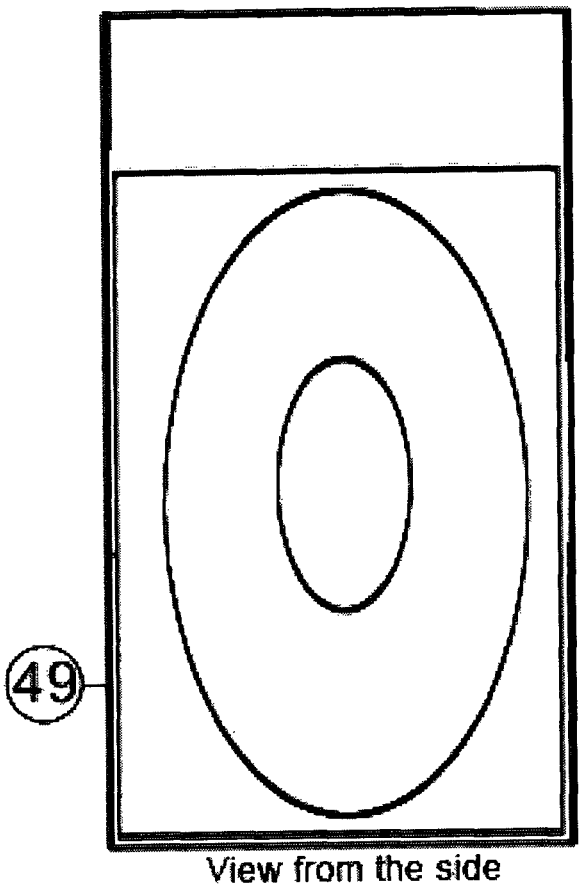
FIG. 9 is a sketch of the magazine with electronic sound generator seen from the side in accordance with the second embodiment as shown in FIG. 5.
Figure 12:
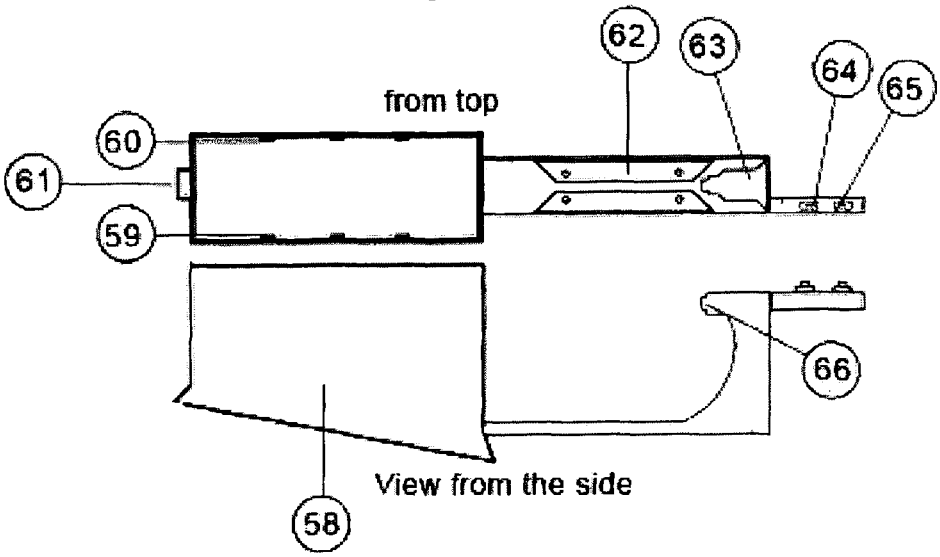
FIG. 12 shows a sketch of a trigger module seen from the side and from above for electronic blank ammunition in accordance with the third embodiment as shown in FIG. 10.
Figure 13:
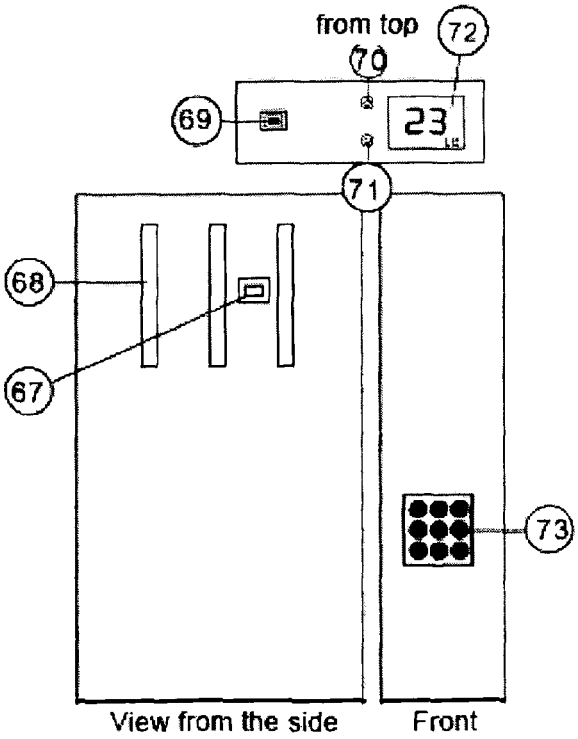
FIG. 13 shows a sketch of the magazine seen from the top, from the front and from the side in accordance with the third embodiment as shown in FIG. 10.
Figure 14:
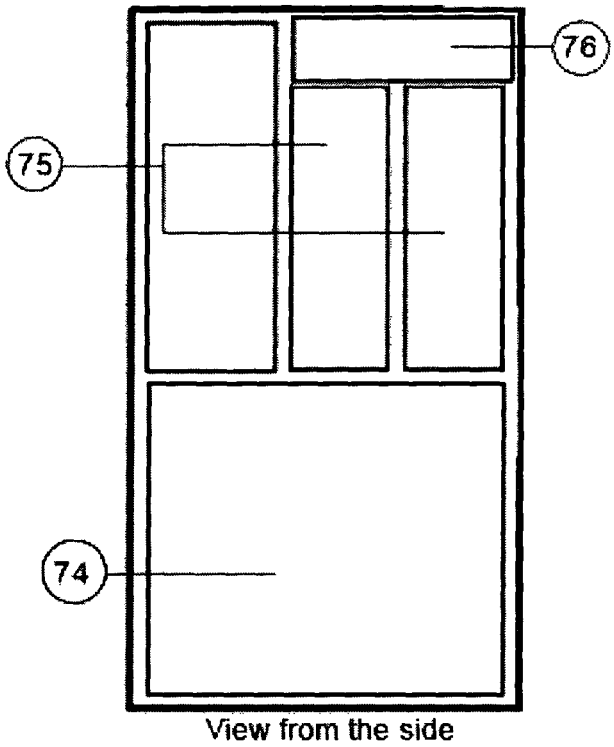
FIG. 14 is a sketch of the interior of the magazine with a battery pack and electronics units in accordance with the third embodiment as shown in FIG. 10.
Figure 16:
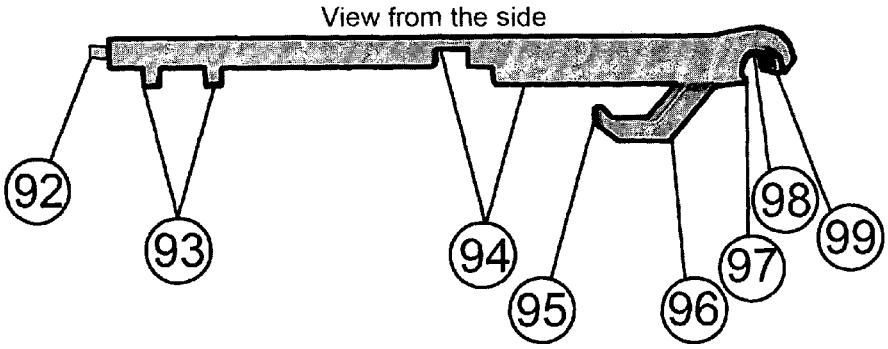
FIG. 16 shows a sketch of a trigger module seen from the side for electronic blank ammunition according to an embodiment of the invention.

A further embodiment of a trigger module according to an embodiment of the invention is shown in FIG. 16. This trigger module can be implemented inside the firing device and also have same functions as the trigger module described above in FIGS. 3,7,12. This is a liner that is installed on the firing device, which is custom-made for each type of device.

Figure 6:
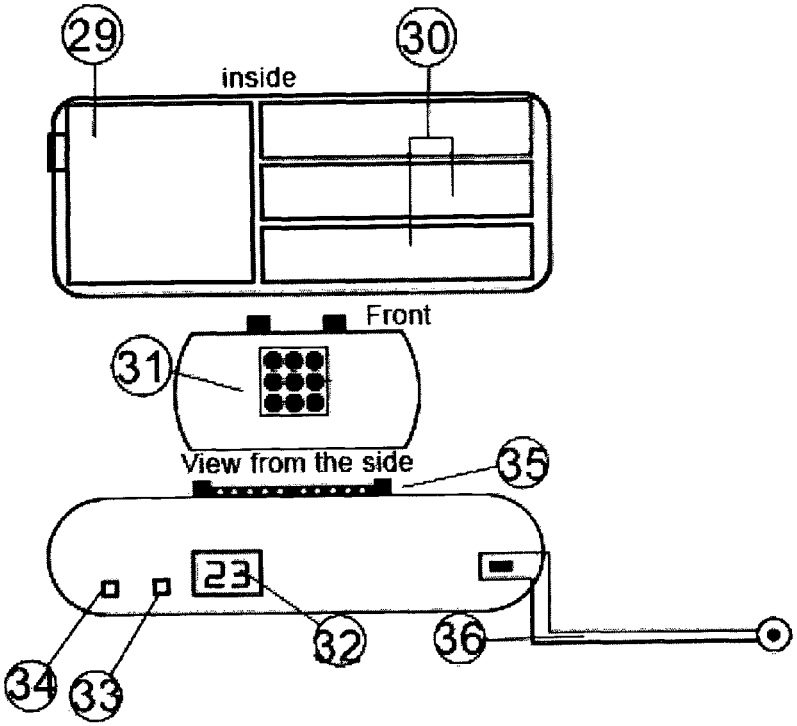
FIG. 6 shows a sketch of the inside of the lighting, electronics and battery module for the second embodiment as shown in FIG. 5.
Figure 11:
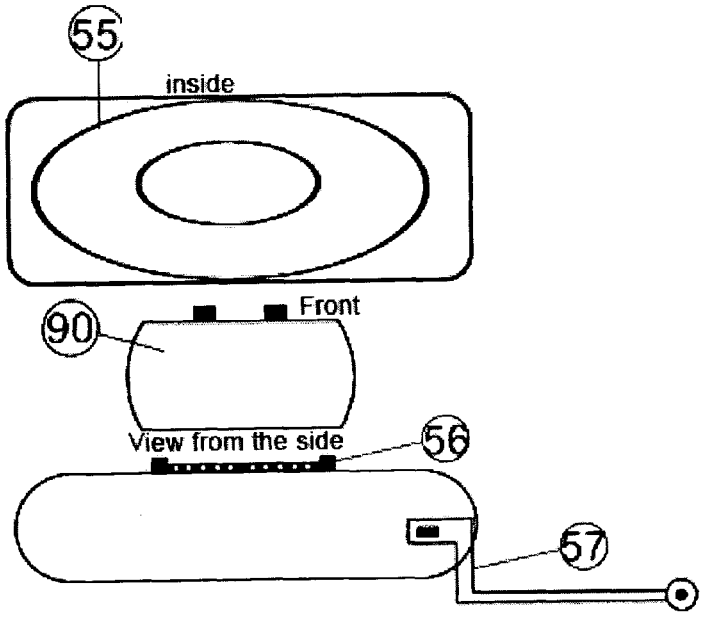
FIG. 11 is a sketch of the interior of the electronic sound generator module, and also its exterior seen from the front and from the side in accordance with the third embodiment shown in FIG. 10.

Contact units (93) lead into the magazine funnel of the firing device to transfer signals to the electronics and battery module FIG. 6 so it can react on the firing device settings and trigger and electronic sound generator module FIG. 11 so it can react on the firing device settings and trigger The magazine is inserted like a regular magazine and has connection with the trigger module through the socket plug (93). The trigger module transfers the firing device settings and trigger signals to the magazine. The trigger module is implemented as a separate module from the magazine. The trigger module may further include at least one sensor for sensing a position of the safety catch of the arms. The trigger module may also be provided with at least one sensor for sensing a position of the trigger of the arms.

The trigger module responds on the firing device triggering and safety systems through a number of switches. The switches are arranged in different positions on the triggering device in accordance with the trigger position inside the weapon. The trigger switch (95) is arranged to respond on trigger movement, safety switch (97) is arranged to respond on safety setting, safety switch (98) is arranged to respond on "semi" shoot setting, safety switch (99) is arranged to respond on auto shoot setting. This is for the firing to correspond with live ammunition firing on personal firing devices. These switches (actuators) are connected to the trigger and the safety mechanism of the weapon. The trigger actuator is mounted on a trigger of the arms and the safety catch actuator is mounted on a safety catch on the arms as will be explained below.

The trigger module is inserted into the firing device with a fitted lock (94,96).

The socket jack (92) can be connected into the connection bridge (36, 57) of the magazine.

FIG. 17

The trigger module shown in FIG. 16 can be implemented inside the firing device with a click-lock system (94,96). The click-lock system connects the trigger of the weapon physically to the trigger module by locking the projection 95 of the trigger module to the internal part of the trigger on the firing device, and by connecting the click-lock system 94, 96 to the firing device mechanism. Mounting of the trigger inside the weapon may be accomplished after opening of the firing device with the firing device opening system.

Figure 17:
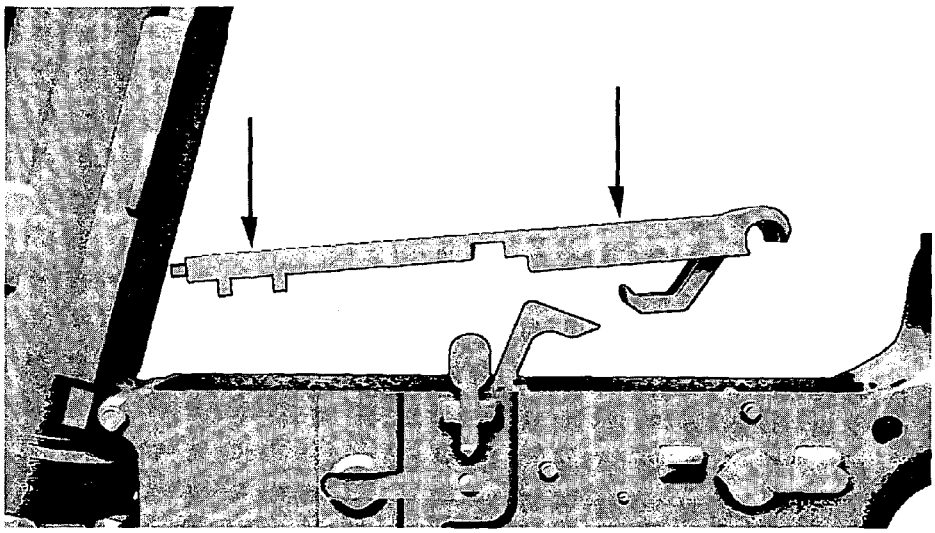
FIG. 17 shows a sketch of a trigger module and section of the firing device seen from the side show how the trigger module in FIG. 16 is installed into the firing device.
Figure 18:
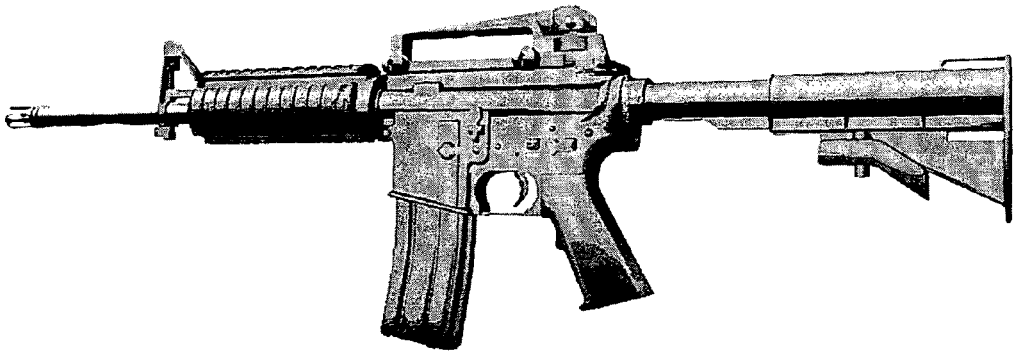
FIG. 18 shows a sketch of a complete firing device included the magazine and a trigger module in FIG. 16 placed inside (not visible in the Figure)

The trigger module is fitted exact to the firing device mechanism and placed directly into the mechanism shown on FIG. 17 and explained above.

When the trigger module is implemented, the firing device can be closed as a normal firing device. The firing device is then ready to be used as a normal firing device.

FIG. 18

For the trigger module solution on FIGS. 16 and 17 the firing device maintains both the original use and appearance.

The system is built up by battery-driven micro-controlled electronics. This is activated via micro-switches attached to the safety catch of the firing device, single or multiple shots. Simulation of shots occurs as the trigger of the firing device activates a micro-switch installed on the device, which in its place activates a micro-controller. This plays a sound file which is sent to a class D amplifier and forwarded to an electronic sound generator in the shape of a loudspeaker. Simultaneously, the micro controller activates an electronic light diode to simulate a muzzle flame by a strong gleam of light. The micro controller registers number of shots fired and remaining shots. This can be read from a LED display, which is installed into a unit of a size corresponding to the live ammunition magazine (1, 25, 50) and the appurtenant trigger module (2, 26, 51).

Mode of Operation

The trigger module is composed of electronic switches which are installed on the safety switch and trigger. These buttons manage the electronic circuit by registering the safety status of the firing device and its trigger.

When the safety status is on 'safe', the electronics and the system will be shut off. When the safety status is on 'single shot', the electronics will start simulation of single shots. The electronic sound generator and electronic light diode, could be activated by the button which is coupled to the trigger of the firing device.

When the safety status is on 'multiple shots', the electronics will start simulation of multiple shots. The use of an electronic sound generator and electronic light diode could be activated by keeping active the button which is coupled to the trigger of the firing device.

First, make a loading motion whereupon the loading motion button is activated (77). Then the safety catch is unfastened and the safety catch button (78) installed. The loading motion button (77) and the safety catch button are connected in series, and as these are installed, the hexfet button (80) will lead and start the set up converter (90) and the micro controller in resting modus, ready for firing. As the loading motion button (77) and the safety catch button are out, the hexfet button resistance (79) will work as an obstruction and the hexfet button (80) will not lead.

The micro controller (91) has five entrances: Button entry for volume control (83) which defines the desired volume level. Button entry for single or multiple shots (82). Trigger entry (84) which derives from the trigger of the firing device. Manual reset (81) and automatic reset at loading (85)

By pulling the trigger (trigger entry) (84), the micro controller will play a recorded sound file equivalent to the sound of a regular ammunition shot, which will be sent to the amplifier (89) and sounded from the electronic sound generator (e.g. a speaker) (88). Simultaneously, a powerful LED light (86) will show as a simulation of the muzzle flame.

The micro controller (91) counts how many shots are fired. After 30 shots the circuit will need to be reset manually (81). The LED display will show how many shots are remaining. After a defined number of resets, the micro controller (91) will lock the circuit and BL will show in the LED display (87) signifying that the batteries need to be recharged. As the batteries are recharged, the entry for automatic reset at loading (85) will be activated and the circuit can be restarted.

Note that the embodiments described above are only examples. Persons skilled in the art will be able to carry out a numerous other modifications and variants of electronic blank ammunition within the framework of the present invention as defined in the enclosed patent claims.

The invention claimed is:

1. A system for electronic simulation of live ammunition when firing a small arms, comprising:

a magazine to be inserted in a magazine funnel of the arms simulating a live ammunition magazine;

a trigger module to be mounted on the arms, the trigger module comprising a trigger actuator for mounting on a trigger of the arms and a safety catch actuator for mounting on a safety catch on the arms; and an electronic sound generating device for simulation of shots.

2. System according to claim 1, comprising an electronic lighting device for simulation of muzzle flame when firing the arms.

3. System according to claim 1, wherein the trigger module further comprises at least one sensor for sensing a position of the safety catch of the arms.

4. System according to claim 1, wherein the trigger module further comprises at least one sensor for sensing a position of the trigger of the arms.

5. System according to claim 1, wherein the trigger module is mounted in connection with a magazine funnel on the arms.

6. System according to claim 1, wherein the trigger module is mounted inside the arms connected to an inner part of the trigger and an inner part of the safety catch.

7. System according to claim 1, wherein the magazine comprises contacts for connection with reciprocal contacts on the trigger module for transfer of signals between the magazine and the trigger module.

8. System according to claim 1, wherein the magazine comprises a bolt micro-switch arranged to be activated by a loading motion of the arms.

9. System according to claim 2, comprising an LED simulating the muzzle flame.

10. System according to claim 1, wherein the magazine comprises at least one battery for powering the system.

11. System according to claim 1, the magazine comprising an electronic controller controlling the simulation.

12. System according to claim 1, the magazine comprising an electronic display indicating a number of shots/rounds fired and a number of shots/rounds remaining.

13. System according to claim 1, comprising a reset button resetting the system.

14. System according to claim 10, wherein said battery is rechargeable.

15. System according to claim 3, wherein the at least one sensor is a switch.

* * * * *